US005655833A

United States Patent [19]

Raczynski

[11] Patent Number: 5,655,833

[45] Date of Patent: Aug. 12, 1997

[54] FREE-STANDING TASK LIGHTING FIXTURE

[75] Inventor: Walter Raczynski, Arlington Heights, Ill.

[73] Assignee: Control ALT Design Ltd., Arlington Heights, Ill.

[21] Appl. No.: 476,270

[22] Filed: Jun. 7, 1995

[51] Int. Cl.[6] ..... F21S 3/00

[52] U.S. Cl. ..... 362/419; 362/427; 362/430; 362/432; 248/125.3; 248/423; 248/295.11; 248/918

[58] Field of Search ..... 362/220, 419, 362/430, 432, 294, 373, 285, 288, 427; 248/125.3, 244, 246, 423, 295.11, 918; 439/32, 34, 110, 534

[56] References Cited

U.S. PATENT DOCUMENTS

| | | | |
|---|---|---|---|
| 836,490 | 11/1906 | D'Olier, Jr. | 362/282 |
| 1,727,361 | 9/1929 | Ashcraft | 362/373 |
| 2,190,439 | 2/1940 | Wohl | 362/429 |
| 2,878,371 | 3/1959 | Hanlin | 362/294 |
| 2,981,917 | 4/1961 | Glass | 439/32 |
| 3,108,752 | 10/1963 | Duprey | 362/294 |
| 4,803,606 | 2/1989 | Rotter | 362/419 |
| 4,850,560 | 7/1989 | Ross | 248/295.11 |
| 5,012,348 | 4/1991 | Witzel et al. . | |
| 5,122,941 | 6/1992 | Gross et al. | 362/419 |
| 5,154,507 | 10/1992 | Collins | 362/285 |
| 5,322,255 | 6/1994 | Garrett . | |
| 5,448,464 | 9/1995 | Moss | 362/419 |

*Primary Examiner*—Ira S. Lazarus
*Assistant Examiner*—Sara Sachie Raab
*Attorney, Agent, or Firm*—Hill, Steadman & Simpson

[57] ABSTRACT

A lighting fixture is slidably mounted on a track support which may advantageously be secured to any existing or available structure within or around the work space. In one preferred embodiment, it is secured to the side of a computer monitor which is either located on or adjacent to the work surface which is to be illuminated. The track support may be mounted on the computer monitor or other surface at any angle from vertical through horizontal thus providing a wide variety of options for an individual using the improved fixture of the present invention. The lamp fixture socket support is preferably rotatably mounted on a sliding car member which moves along the track support and also provides a first axis of rotation for the fixture. A reflector housing is also rotatably secured to the sliding car or fixture which thus provides a second axis of rotation for the fixture allowing greatest flexibility for positioning the lamp.

16 Claims, 3 Drawing Sheets

FREE-STANDING TASK LIGHTING FIXTURE

BACKGROUND OF THE INVENTION

1. Field of the Invention

The present invention relates generally to the field of illumination devices and, more particularly, the present invention relates to an improved lighting fixture which is movable along an elongated track support member and radially adjustable about two axes of rotation. In a preferred embodiment, the fixture is advantageously affixed to the side of a computer monitor to provide illumination for a work surface adjacent the computer monitor without interfering with or competing for the limited usable surface area of the work space environment.

2. Description of the Related Art

A wide variety of lighting fixtures are available in the related art for providing work surface illumination. These fixtures can be divided primarily into two classes: those which provide ambient or surrounding room lighting; and, those which provide direct illumination for a specific surface area. Fixtures which provide ambient light in offices and other work environments include a wide variety of overhead fixtures which generally employ fluorescent bulbs although sometimes filament and organo-metallic arc (such as metal halide) type lamps are used as well. Those fixtures which provide direct work surface illumination come in a wide variety of styles and shapes as well. The light sources for these fixtures include filament lamps and fluorescent tubes as well as halogen bulbs. While existing direct surface illumination devices are generally satisfactory for providing adequate light and may even employ a visually appealing support structure, the use of these fixtures poses a problem for current day work environments in that there often is insufficient space on the work surface for the fixture. This is especially true in today's office and engineering environment wherein a number of pieces of electronic equipment are competing for the same limited work surface. This has primarily come about due to the advent of the personal computer.

Rapid technological change brought about by the personal computer has significantly changed most present day working environments. We work today in highly automated electronic environments which bear little resemblance to the work places of the past. While many of us work at desks, unlike the desks of our predecessors, our desks are often dominated by computers and associated equipment in addition to conventional device such as phones and dictating machines.

The conventional computer monitor has come to dominate not only our attention but also the physical confines of the desk surface itself. Other computer peripherals have also successfully competed for desk top turf and won. These peripherals include items such as printers, disk drives, modems, multimedia speakers, scanners. The existing work surface must be divided among these devices in addition to dictating equipment, telephones and the like. It is remarkable that there is any space remaining on the surface of the desk for the tasks at hand.

Desks have come to grow appendages such as keyboard shelves, printer drawers, keyboard carrels and the like in an attempt to respond and adapt to the physical imposition of space which our new computing tools demand. The remaining space has become so precious in a working environment that illumination considerations have at worst often been totally ignored or at best simply become an afterthought.

Conventional lamps either rest upon a base or are clamped via a base directly to the work surface. The lamp therefore competes for desk top space which is already scarce. Often times because of concerns of space the lamp loses this battle and is not even located on the desk. This is unfortunate because it encourages an unhealthy and wasteful energy practice.

Often to compensate for poor quality or even nonexistent work surface illumination, modern office planners simply add more general or "ambient" illumination to the office environment. This is undesirable in that it increases operational costs because of increased electrical consumption and it also results in over illumination which causes glare directed at the unfortunate office worker from the computer monitor's glass screen. This glare masks and obscures the underlying information contained within the monitors CRT screen forcing the user to squint and strain his or her eyes in order to read the computer screen.

Computing technology has not eliminated or reduced the consumption and use of paper, to the contrary, it is evident today that there is actually more paper used and generated by the office workers because making revisions to documents has become easier with the computer. Reading the information on this paper or taking information from objects directly and transcribing this information via the keyboard and monitor if performed under the above mentioned conditions of high glare, low intensity or otherwise poor illumination not only leads to decreased worker productivity but also results in eye strain and headaches as well as other short and long term negative health effects.

Because our desks are overfilled in no small part because of this new technology and because we still work with paper and other things which we need to view and examine and transcribe while we are at computers and because simply adding more overhead illumination is wasteful and actually deleterious to the work environment, there remains a need for an improved and adjustable task-illumination system which can provide enhanced illumination well as lower operating costs overall and energy consumption but which will not intrude into available desk or table space and be minimally intrusive into the work space.

It is thus a first object of the present invention to provide an improved lighting fixture which is capable of providing direct work surface illumination without interfering with or competing for the existing work surface.

It is another object of the present invention to provide an improved lighting fixture for a work surface which is sufficiently moveable and rotatable to direct the light from the fixture source toward any desired location on the work surface.

It is another object of the present invention to provide a work surface illuminating fixture which is slidable along a fixed mounting track and rotatable about at least one axis of rotation.

It is a further object of the present invention to provide a lighting fixture which solves the above-mentioned problems related to providing adequate work surface illumination but which is also is easily manufactured and adjusted.

It is yet another object of the present invention to provide a lighting fixture which provides a visually appealing structure for the fixture.

These and other objects of the present invention will become apparent from the following summary, and detailed description of the present invention in light of the drawings.

SUMMARY OF THE INVENTION

In a preferred embodiment of the present invention, a lighting fixture is slidably mounted on a track support which may advantageously be secured to any existing or available structure within or around the work space. In one preferred embodiment, it is secured to the side of a computer monitor which is either located on or adjacent to the work surface which is to be illuminated. The track support may be mounted on the computer monitor or other surface at any angle from vertical through horizontal thus providing a wide variety of options for an individual using the improved fixture of the present invention. The lamp fixture socket support is preferably rotatably mounted on a sliding car member which moves along the track support and also provides a first axis of rotation for the fixture. A reflector housing is also rotatably secured to the lamp fixture socket support member or fixture which thus provides a second axis of rotation for the fixture allowing greatest flexibility for positioning the resulting illumination. In a preferred embodiment, the track member is roughly of a trapezoidal or T-shaped cross-section with the more narrow portion secured to the computer monitor or other support surface to provide support for the sliding car while also allowing the sliding car and fixture support to move therealong. A detent spring in the sliding car member engages depressions along the length of the track member to allow the sliding car to be temporarily secured at various positions along the length of the track.

For ease of manufacture and in order to reduce the cost of the improved fixture while increasing safety, a plug-in, wall-mounted ballast supplies the appropriate voltage for the lamp. Rather than having electrical connectors feed through the track member and sliding oar, a flexible cable advantageously feeds either through the sliding car directly or it alternately may feed directly to the lamp socket. In the embodiment wherein the power cable feeds through the sliding car, an on/off switch is desirably located therein to provide easy access to the power control. The switch may also incorporate a dimmer switch as well to adjust the amount of light generated by the lamp. The sliding car and track as well as the reflector housing may be advantageously manufactured from a sturdy plastic.

In a preferred embodiment, an elongated parabolic reflector housing is rotatably secured to the lamp fixture socket support member in order to allow further directivity of the light source without requiring the electrical components contained therein to rotate. The reflector housing may also incorporate a light/heat reflector, a light modulating diffuser and a light modifying grid panel.

DETAILED DESCRIPTION OF THE PRESENTLY PREFERRED EMBODIMENTS

Figure 1:
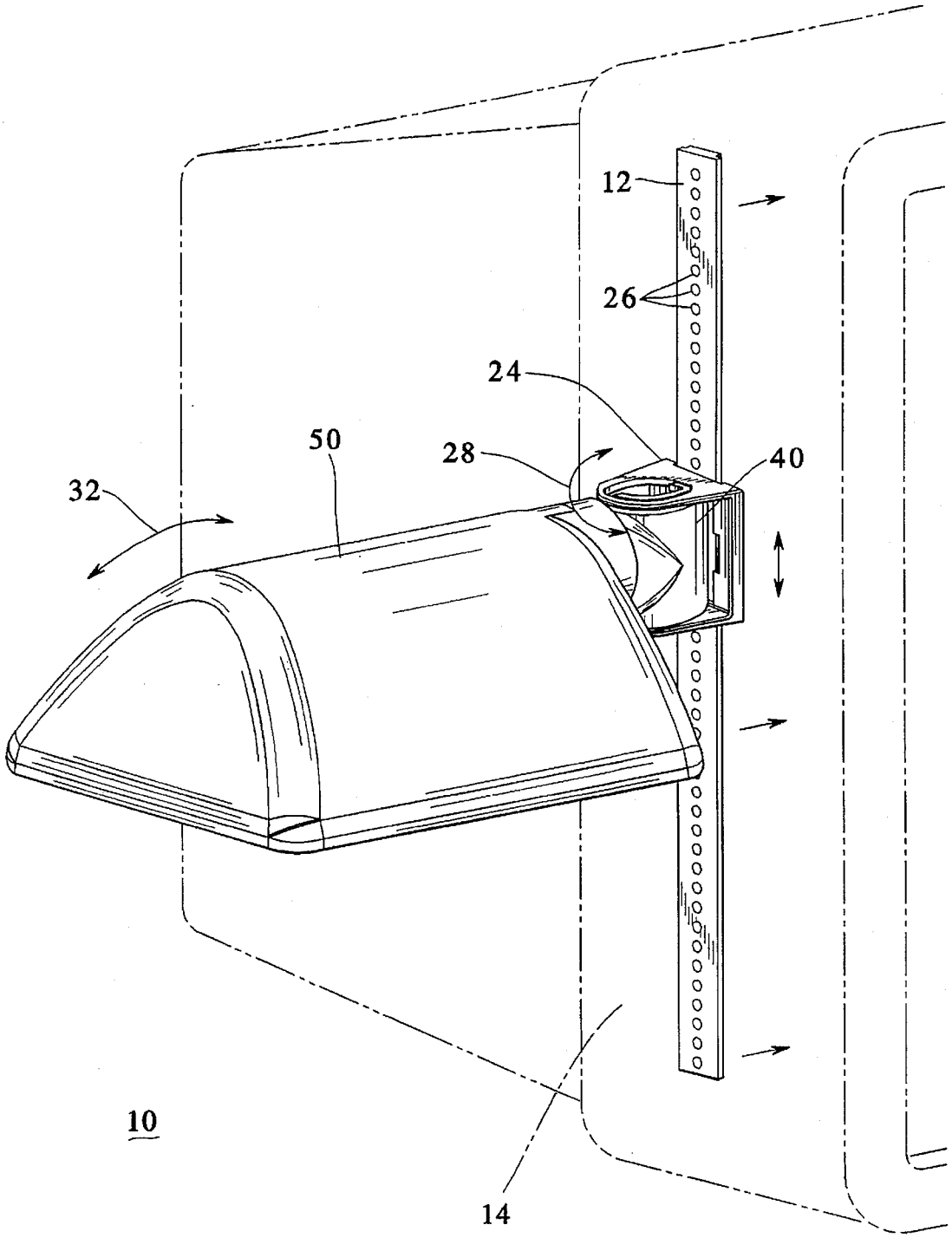
FIG. 1 illustrates a first preferred embodiment of the lighting fixture of the present invention wherein the support member is affixed to the side of a computer monitor.

A first preferred embodiment of the improved lighting fixture of the present invention is shown in FIG. 1 generally at 10. A substantially linear track support member 12 is mounted on the side of a conventional computer monitor 14. The track member 12 of the preferred embodiment is mounted via a double sided adhesive tape to the side of computer monitor 14. In the illustration the track member 12 is mounted substantially vertical with respect to the computer monitor 14, however, it is recognized that individual preferences may dictate a particular user's preference for arrangement of the track member 12. It is recognized that the track member may be advantageously placed in a horizontal direction as well, or at any angle between horizontal and vertical. It may also be desirable, for example, to employ velcro as a means for securing the fixture of the present invention to the side of the computer or other structure for a more temporary placement of the fixture. Additional means of permanent attachment is possible by using screws. To that end, a number of velcro patches may be secured to the side of the computer at various locations and along the track member 12 to allow more varied placement of the improved lighting fixture. The track member 12 is advantageously of either a trapezoidal or T-shape with its more narrow side secured to the side of the computer monitor.

A sliding car member 24 slidably engages the track member 12. Dimples or other indentations 26 on the track support member 12 are engaged by a detent pin member on the sliding car 24 that is not shown in this view and which cooperates with the dimples or indentations to allow the temporary placement of the lamp fixture at various positions along the length of the track member 12. A fixture socket support member 40 is rotatably secured within the sliding car 24 and provides for the adjustment of the lighting fixture about a first axis of rotation shown by the arrow 28 which is substantially parallel to the track member 12. The fixture socket support 40 provides for the support and adjustment of the lighting fixture and reflector housing 50. The reflector housing 50 is preferably of an elongated parabolic shape to properly reflect the lamp light toward the work surface and to also provide a visually appealing structure. The reflector housing 50 is also rotatably secured to either the fixture socket support 40 or alternately it may be directly secured to an external portion of the socket which is mounted to the fixture socket support 40. Because the reflector housing 50 is rotatably secured, the fixture thus has a second axis of rotation about the axis defined by the arrow 32 which is substantially perpendicular to the track member 12. In the preferred embodiment, the reflector housing 50 rotates without rotation of the lamp itself. This design is less complex because it allows the reflector to rotate without also requiring that the electrical connections to the lamp rotate as well.

The fixture of the present invention is thus able to provide direct illumination to the work surface adjacent the computer monitor without consuming the available work surface space and without needlessly increasing the ambient room lighting. The versatility and mobility of the lamp structure is particularly desirable in that it can readily provide direct illumination to text or other material which is often placed in the space adjacent the computer without competing for the available work surface.

Figures 2, 2A:
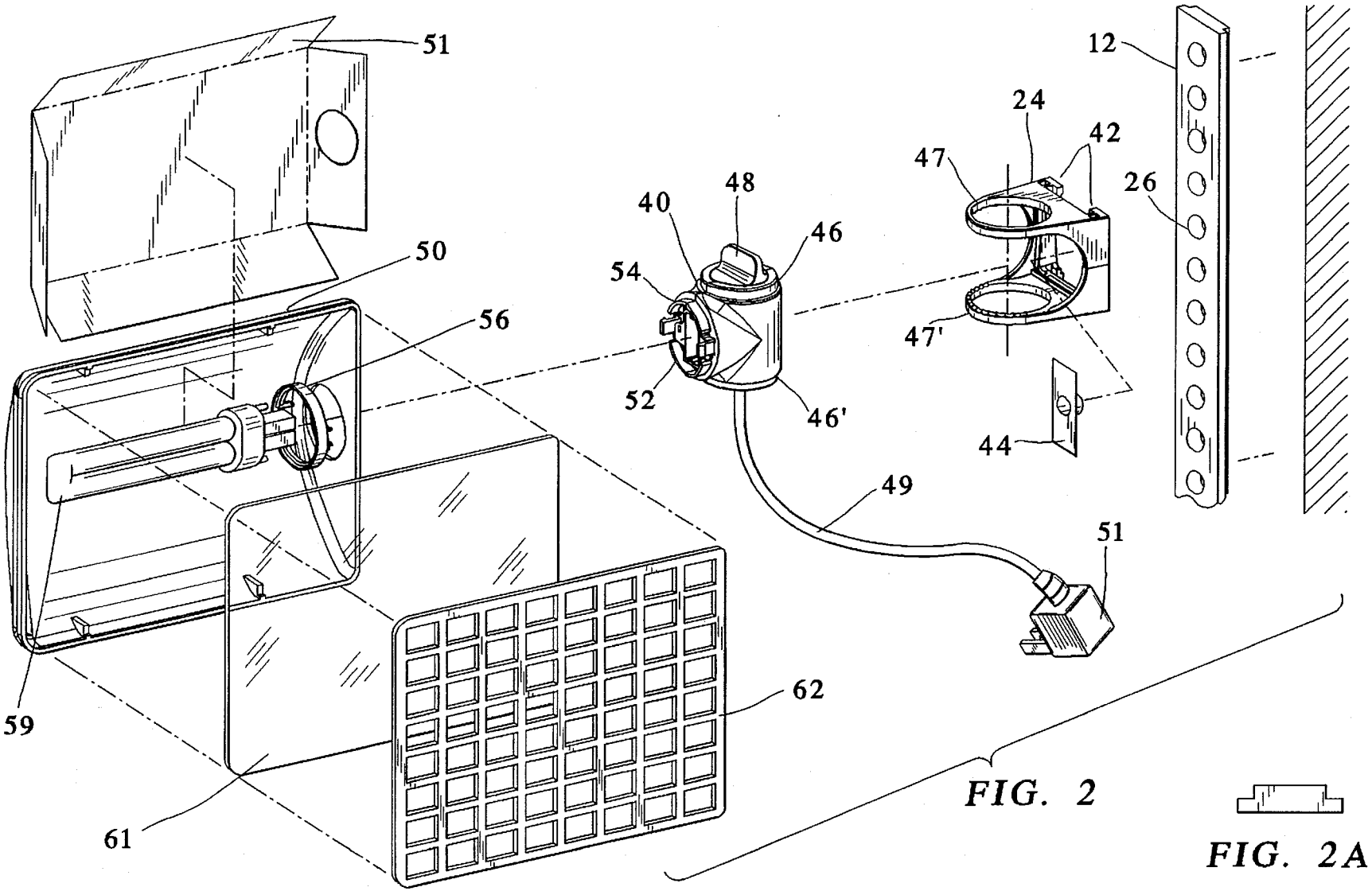
FIG. 2 illustrates an exploded view of the lighting fixture of the present invention illustrated in FIG. 1.
FIG. 2A illustrates a cross-section of element 12 of FIG. 2.

FIG. 2 illustrates an exploded view of the preferred embodiment of the lighting fixture illustrated in FIG. 1. In this preferred embodiment the trapezoidal track support 12 is shown detached from its attachment surface. The track support 12 is of a trapezoidal shape so that with its more narrow side secured to the computer monitor or other support surface, the sliding car 24 may slidably engage the track 12. As previously noted, the track may have a T-shaped cross section which will advantageously allow movement of the sliding car. The sliding car 24 is also shown detached from the track support 12. In this view, engaging tabs 42 can be seen which extend from the base of the sliding car 24 and secure the sliding car 24 to the track support 12. The spring detent pin 44 is also shown in a detached condition from the sliding car 24. When properly secured, the spring detent pin 44 is located beneath the sliding car 24 between the sliding car 24 and the track support 12 so that the spring detent pin 44 may engage the dimples 26 in the track support 12 for temporarily securing the sliding car at various positions along the length of the track support 12. The fixture socket support 40 has a substantially cylindrical base with upper and lower ring depressions 46 and 46' respectively which engage corresponding upper and lower support rings 47 and 47' located in the sliding car 24. A switch 48 is secured within the fixture socket support 40 for selectively applying power to the lamp. The fixture socket support 40 is inserted into the sliding car 24 by applying slight pressure between the upper and lower support rings 47 and 47' of the sliding car to allow insertion of the fixture support 40. Upon insertion of the fixture socket support 40, the upper and lower ring depressions 46 and 46' respectively engage corresponding upper and lower support rings 47 and 47' located in the sliding car 24.

A power cord 49 extends from the bottom of the fixture socket support 40 and extends to an ac converter or lamp ballast 51 to provide power to the lamp. The lamp socket 52 extends outward from the side of the fixture socket support 40 and has a further depressed ring 54 for receiving a corresponding opening in the reflector structure 50. A securing ring 56 snap-fits into the further depressed ring extending from the lamp socket of fixture socket support 40 to rotatably secure the reflector housing 50 to the fixture socket support 40. This allows rotation of the lamp reflector without also requiring rotation of the lamp itself. A light reflector/heat dissipator 51 may also be optionally secured with the securing ring 56 within the reflector housing 50. Additionally, a light modulating diffuser 61 and a light modifying grid panel 62 may also be attached to, or secured within the reflector housing 50.

Figure 3:
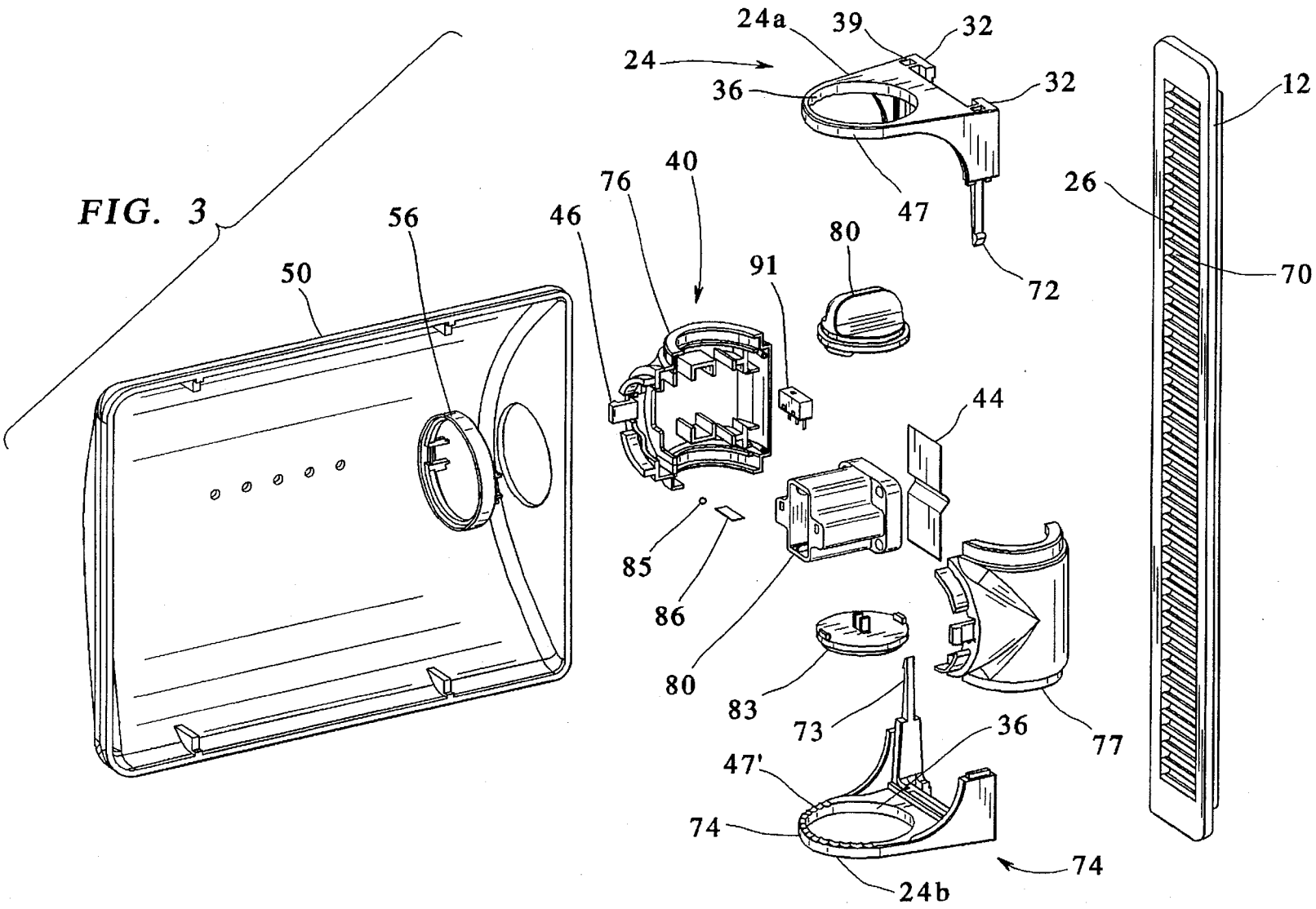
FIG. 3 illustrates an exploded view of an alternate embodiment of the lighting fixture of the present invention.

FIG. 3 illustrates a further exploded view of the improved lighting fixture of the present invention wherein an alternate embodiment of the support track 12 is shown. In this embodiment, the dimples 26 of FIGS. 1 and 2 have been replaced by depressed ridges 70 which engage the detent spring 44 which is secured between the sliding car 24 and the support track 21. FIG. 3 also provides more detail related to the placement of the switch and the lamp socket within the fixture socket support 40. From this view, it is apparent that the sliding car member 24 is comprised of upper and lower sections 24 *a* and 24 *b* respectively. The upper and lower sections of the sliding car member 24*a* and 24*b* each have respective snap locks 72 and 73 which engage grooves and corresponding locking members located in the opposite sections of the sliding car member 24. In the preferred embodiment, at least the lower section 24*b* has rotational detents 74 in the lower support ring which are used to temporarily fix the fixture socket support in various positions of rotation.

FIG. 3 also illustrates how the fixture socket support 40 is actually comprised of a number of different plastic molded sections as well. First and second fixture socket support halves 76 and 77 snap fit together to form the fixture socket support housing. The fixture socket support halves 76 and 77 secure the lamp socket primarily within an inner cavity when they are snap-fit to each other. A strain relief 83 is also secured to the bottom of the fixture socket support 40 by an internal depressed ring within which the edge of the strain relief is secured. A ball detent 85 and corresponding ball detent spring 86 are secured within fixture socket support such that the ball detent is in mating engagement with the rotational detents 74 in the lower support ring 47' of the sliding car 24. This allows the socket support to be temporarily fixed in varying degrees of rotation. An electric power switch 91 and corresponding switch activator 80 are also advantageously secured within the fixture socket support 40. A depressed ring within each of the fixture socket support halves secures the switch activator when the two halves are mated with one another. The switch activator 80 and corresponding switch 91 are fixed within the cavity formed by the fixture socket support halves so that a ramp on the bottom of the switch activator 80 engages a spring-loaded member on switch 91 upon rotation of the switch activator to thus allow selective operation of the lamp which is not shown in this view. The vertical detent spring 44 is sandwiched between the fixture socket support 40 and the track 12 when the fixture socket support housing is secured to the sliding car 24 and the sliding car is attached to the track 12. The reflector housing 50 and the reflector housing attachment ring 56 are also shown in this view detached from the fixture socket support 40.

This preferred embodiment of the design for the improved lighting fixture of the present invention thus provides a simple and economical approach for the manufacture of the improved fixture. It can be seen that the lighting fixture of the present invention readily provides work surface illumination on a surface adjacent to a computer monitor without consuming additional surface space and without unnecessarily increasing the ambient room lighting.

Although the drawings illustrate the preferred embodiment of the present invention, it is recognized that other similar structures will provide the advantages of this design as well. For example, the disclosed structure for providing first and second axes of rotation for the fixture could be replaced by a universal type joint fixed to the support track. In such a design, the fixture socket support would then be secured to the universal joint and the light from the lamp could be directed in an equally versatile manner. Other structural changes could be made as well while falling within the scope of the claimed invention.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

I claim as my invention:

1. A work space illuminating fixture comprising:

an elongated supporting track attached to a substantially vertical surface;

a fixture support car in sliding engagement with the supporting track;

a fixture socket support rotatably mounted to the fixture support car; and a reflector housing rotatably mounted to the fixture socket support, wherein the supporting track has a plurality of dimples for temporarily securing the fixture support car.

2. The work space illuminating fixture of claim 1, wherein the reflector housing is comprised of an elongated rectangular parabolic reflector.

3. The work space illuminating fixture of claim 1, wherein the fixture socket support further comprises an electric switch secured within a cavity in the fixture socket support.

4. The work space illuminating fixture of claim 1, wherein the reflector housing has a light reflector/heat dissipator secured within an inner cavity of the reflector housing.

5. The work space illuminating fixture of claim 1, wherein a detent spring is secured between the fixture support car and the supporting track.

6. A work space illuminating fixture comprising:

an elongated supporting track attached to a substantially vertical surface;

a fixture support car in sliding engagement with the supporting track;

a fixture socket support rotatably mounted to the fixture support car; and a reflector housing rotatably mounted to the fixture socket support, wherein upper and lower support rings extend from the fixture support car substantially perpendicular to the supporting track to rotatably secure the fixture socket support to the fixture support car.

7. A work space illuminating fixture comprising:

an elongated supporting track fixed to a side of a monitor;

a fixture support car in sliding engagement with the supporting track;

a fixture socket support rotatably mounted to the fixture support car; and a reflector housing rotatably mounted to the fixture socket support.

8. The work space illuminating fixture of claim 7, wherein the supporting track has a plurality of dimples for temporarily securing the fixture support car.

9. The work space illuminating fixture of claim 7, wherein the reflector housing is comprised of an elongated rectangular parabolic reflector.

10. The work space illuminating fixture of claim 7, wherein the fixture socket support further comprises an electric switch secured within a cavity in the fixture socket support.

11. The work space illuminating fixture of claim 7, wherein the reflector housing has a light reflector/heat dissipator secured within an inner cavity of the reflector housing.

12. The work space illuminating fixture of claim 7, wherein upper and lower support rings extend from the fixture support car substantially perpendicular to the supporting track to rotatably secure the fixture socket support to the fixture support car.

13. The work space illuminating fixture of claim 7, wherein a detent spring is secured between the fixture support car and the supporting track.

14. A work space illuminating fixture comprising:

an elongated supporting track fixed to a side of a monitor;

a fixture support car in sliding engagement with the supporting track; and a means for rotating a reflector housing about first and second axis of rotation attached to the fixture support car.

15. The work space illuminating fixture of claim 14, wherein the supporting track has a plurality of dimples for temporarily securing the fixture support car.

16. The work space illuminating fixture of claim 14, wherein the reflector housing is comprised of an elongated rectangular parabolic reflector.

* * * * *

US005655833C1

(12) EX PARTE REEXAMINATION CERTIFICATE (4849th)

United States Patent

Raczynski

(10) Number: US 5,655,833 C1

(45) Certificate Issued: Sep. 23, 2003

(54) FREE-STANDING TASK LIGHTING FIXTURE

(75) Inventor: Walter Raczynski, Arlington Heights, IL (US)

(73) Assignee: Control Alt Design Ltd., Arlington Heights, IL (US)

Reexamination Request:
No. 90/006,151, Oct. 31, 2001

Reexamination Certificate for:

| | |
|---|---|
| Patent No.: | **5,655,833** |
| Issued: | **Aug. 12, 1997** |
| Appl. No.: | **08/476,270** |
| Filed: | **Jun. 7, 1995** |

(51) Int. Cl.[7] ..... F21L 14/00

(52) U.S. Cl. ..... 362/419; 362/427; 362/430; 362/432; 248/423; 248/125.3; 248/295.11; 248/918

(58) Field of Search ..... 362/220, 419, 362/430, 432, 294, 373, 285, 288, 427; 248/125.3, 244, 246, 423, 295.11, 918; 439/32, 34, 110, 534

(56) References Cited

U.S. PATENT DOCUMENTS

| | | | | | |
|---|---|---|---|---|---|
| 836,490 | A | * | 11/1906 | D'Olier, Jr. | 362/282 |
| 3,511,985 | A | * | 5/1970 | Muscovitch | 362/282 |
| 4,414,609 | A | * | 11/1983 | Shemitz | 362/33 |
| 4,528,618 | A | * | 7/1985 | Bitsch | 362/33 |
| 4,609,979 | A | * | 9/1986 | Kristofek | 362/427 |
| 4,617,612 | A | * | 10/1986 | Pritchett | 362/33 |
| 4,626,969 | A | * | 12/1986 | Kristofek | 362/147 |
| 4,652,983 | A | * | 3/1987 | Mytels | 362/220 |
| 4,924,365 | A | * | 5/1990 | Bogdanovs | 362/224 |
| 4,934,933 | A | * | 6/1990 | Fuchs | 433/79 |
| 5,012,348 | A | * | 4/1991 | Witzel et al. | 348/373 |
| 5,035,392 | A | * | 7/1991 | Gross et al. | 248/442.2 |
| 5,035,393 | A | * | 7/1991 | Menaged | 248/456 |
| 5,098,128 | A | * | 3/1992 | Husta | 281/45 |
| 5,116,011 | A | * | 5/1992 | Smith | 248/346.03 |
| 5,122,941 | A | * | 6/1992 | Gross et al. | 362/276 |
| 5,292,099 | A | * | 3/1994 | Isham et al. | 248/442.2 |
| 5,322,255 | A | * | 6/1994 | Garrett | 248/299.1 |
| 5,333,103 | A | * | 7/1994 | Cvek | 362/413 |
| 5,751,117 | A | * | 5/1998 | Abbott | 315/244 |

OTHER PUBLICATIONS

Defendant's Responses to Plaintiff's First Set of Interrogatories to Defendants—Jul. 19, 2001.

Defendant's Supplemental Responses to Plaintiff's First Set of Interrogatories to Defendants—Jul. 27, 2001.

Defendant's Additional Supplemental Responses to Plaintiff's First Set of Interrogatories to Defendants—Jul. 30, 2001.

Control ALT's Objection and Responses to Tensor's First Set of Interrogatories (Nos. 1–25) Aug. 27, 2001.

Control ALT's Supplemental Objections and Responses to Tensor's First Set of Interrogatories (Nos. 1–25) Oct. 5, 2001.

Defendant's Motion and Brief Supporting Motion for Summary Judgment of Invalidity Aug. 15, 2001.

Control ALT's Response to Defendant's Motion for Summary Judgment of Invalidity Sep. 19, 2001.

(List continued on next page.)

*Primary Examiner*—Thomas M. Sember

(57) ABSTRACT

A lighting fixture is slidably mounted on a track support which may advantageously be secured to any existing or available structure within or around the work space. In one preferred embodiment, it is secured to the side of a computer monitor which is either located on or adjacent to the work surface which is to be illuminated. The tract support may be mounted on the computer monitor or other surface at any angle from vertical through horizontal thus providing a wide variety of options for an individual using the improved fixture of the present invention. The lamp fixture socket support is preferably rotatably mounted on a sliding car member which moves along the track support and also provides a first axis of rotation for the fixture. A reflector housing is also rotatably secured to the sliding car of fixture which thus provides a second axis of rotation for the fixture allowing greatest flexibility for positioning the lamp.

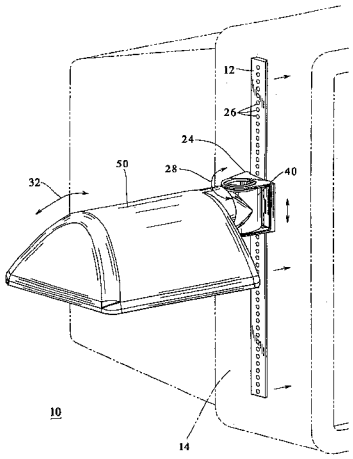

OTHER PUBLICATIONS

Defendant's Brief in Reply to Plaintiff's Opposition to Defendant's Motion for Summary Judgment of Invalidity Oct. 1, 2001.
Defendant's Motion and Brief Supporting Motion for Summary Judgment of Invalidity Aug. 15, 2001.
Decision and Order Nov. 16, 2001.
Rule 26(a)(2)(B) Expert Witness Report of David Frisch Aug. 28, 2001.
Deposition of David Frisch Oct. 11, 2001.
Rule 26(a)(2)(B)Expert Witness Report of David Frisch Apr. 28, 2001.
Rule 26(a)(2)(B) Expert Witness Report of Michael Thuma Aug. 8, 2001.
Deposition of Michael Thuma Oct. 10, 2001.
Deposition Exhibit Thuma 1 U.S. Pat. No. 5,655,833 Oct. 10, 2001 SL.
Notice of Filing and Control Alt's Proposed Claim Construction Dec. 18, 2001.
Defendant's Proposed Claim Construction Dec. 11, 2001.
Deposition Exhibit Thuma 4 U.S. Pat. No. 5,655,833 Oct. 10, 2001 SL.
Deposition Exhibit Thuma 3 Oct. 10, 2001 SL U.S. Pat. No. 5,333,103.
Deposition Exhibit Thuma 6 U.S. Pat. No. 6,168,292 Oct. 10, 2001 SL.
Depositon Exhibit Thuma 7 Oct. 10, 2001 SL.
Depositon Exhibit Thuma 6 Oct. 10, 2001 SL.
Depositon Exhibit Thuma 5 U.S. Pat. No. 6,168,292 Oct. 10, 2001 SL.
Depositon Exhibit Thuma 10 FIG. 3 U.S. Pat. No. 6,168,292 Oct. 10, 2001 SL.
Depositon Exhibit Thuma FIG. 1 U.S. Pat. No. 333,103 Oct. 10, 2001 SL.
Depositon Exhibit Thuma 8 Oct. 10, 2001 SL.
Agreed Jury Instruction Dec. 3, 2001.
Verdict Form Dec. 13, 2001.
Vol. 1A Transcript of Proceedings Before the Honorable Joan Humphrey Lefkow Dec. 10, 2001.
Vol. 1B Transcript of Proceedings Before the Honorable Joan Humphrey Lefkow Dec. 10, 2001.
Vol. 2A Transcript of Proceedings Before the Honorable Joan Humphrey Lefkow Dec. 11, 2001.
Vol. 2B Transcript of Proceedings Before the Honorable Joan Humphrey Lefkow Dec. 11, 2001.
Vol. 3A Transcript of Proceedings Before the Honorable Joan Humphrey Lefkow Dec. 12, 2001.
Vol. 3C Transcript of Proceedings Before the Honorable Joan Humphrey Lefkow Dec. 12, 2001.
Vol. 4A Transcript of Proceedings Before the Honorable Joan Humphrey Lefkow Dec. 13, 2001.
Deposition of Joseph Romeo Jul. 30, 2001.
Minute Order Dec. 13, 2001.
Deposition of Chris Kirkbride Aug. 1, 2001.
Print out of web page www.tensorlamp.com.
Deposition of Roger N. Sherman Aug. 30, 2001.
Declaration of Michael Thuma Jan. 5, 2003.
Stipulated Order of Dismissal Jan. 3, 2002.

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *